US007699492B2

(12) United States Patent
Levine

(10) Patent No.: US 7,699,492 B2
(45) Date of Patent: Apr. 20, 2010

(54) LIGHTING DEVICE WITH CLIP

(76) Inventor: Jonathan E. Levine, 419 Park Ave. S., Suite 505, New York, NY (US) 10024

( * ) Notice: Subject to any disclaimer, the term of this patent is extended or adjusted under 35 U.S.C. 154(b) by 48 days.

(21) Appl. No.: 11/945,963

(22) Filed: Nov. 27, 2007

(65) Prior Publication Data

US 2008/0137326 A1 Jun. 12, 2008

Related U.S. Application Data

(60) Provisional application No. 60/873,658, filed on Dec. 8, 2006, provisional application No. 60/878,733, filed on Jan. 4, 2007.

(51) Int. Cl.
*F21L 4/00* (2006.01)

(52) U.S. Cl. ..... 362/191; 362/157; 362/198; 362/249.01; 362/249.02; 362/285

(58) Field of Classification Search ..... 362/157, 362/191, 198, 249.01–249.1, 285, 287, 370, 362/427, 800
See application file for complete search history.

(56) References Cited

U.S. PATENT DOCUMENTS

| | | | |
|---|---|---|---|
| 2,345,235 | A | 3/1944 | Carter, Jr. |
| D151,855 | S | 11/1948 | Nitardy |
| 2,555,000 | A | 5/1951 | Nitardy |
| 2,595,520 | A | 5/1952 | Guerin |
| 2,790,894 | A | 4/1957 | Zingone |
| D264,254 | S | 5/1982 | Heritage |
| 4,494,177 | A | 1/1985 | Matthews |
| D278,461 | S | 4/1985 | Pepall |
| 4,515,570 | A | 5/1985 | Beltran |
| 4,528,618 | A | 7/1985 | Bitsch |
| 4,595,970 | A | 6/1986 | Diffrient |
| D293,940 | S | 1/1988 | Lasker |
| 4,751,627 | A | 6/1988 | Usher |
| D299,549 | S | 1/1989 | Macaluso |
| 4,816,969 | A | 3/1989 | Miller |
| D312,136 | S | 11/1990 | Miletich et al. |

(Continued)

OTHER PUBLICATIONS

"Fulcrum 113311-301 Flyweight Travel Booklight," http://www.amazon.com/Fulcrum-113311-301-Flyweight-Travel-Booklight/dp/B0006JN7XC, visited Aug. 17, 2007, 1 page.

(Continued)

*Primary Examiner*—Sandra L O'Shea
*Assistant Examiner*—Meghan K Dunwiddie
(74) *Attorney, Agent, or Firm*—Theodore W. Baker

(57) ABSTRACT

A lighting device is disclosed. The lighting device can be battery-powered and can include one or more LEDs within a light source housing. The device can also include a base connected to the light source housing, and a clip removably connected to the base. The base can act as a stable support for the lighting device when the lighting device is positioned upright over a flat support surface with the clip disconnected from the base. Similarly, the clip (or the clip in conjunction with a portion of the base) can act as a stable support for the lighting device when the lighting device is positioned upright over a flat support surface with the clip connected to the base. The clip can be configured to releasably connect to the base in a first orientation and a second orientation substantially opposite to the first orientation.

14 Claims, 7 Drawing Sheets

U.S. PATENT DOCUMENTS 5,012,394 A 4/1991 Woodward
D320,863 S 10/1991 Macaluso
D322,681 S 12/1991 Yuen
5,169,226 A 12/1992 Friedman
5,265,000 A 11/1993 Lin
D350,620 S 9/1994 Yuen
D357,993 S 5/1995 Yuen
5,510,970 A * 4/1996 Hollenbach et al. ..... 362/396
5,595,436 A 1/1997 Way, Jr. et al.
D377,990 S 2/1997 Nakano
5,765,793 A * 6/1998 Yu ..... 248/126
5,765,939 A 6/1998 Tanner, Jr.
5,769,529 A 6/1998 Weinstock et al.
5,871,274 A 2/1999 Lee et al.
5,934,787 A 8/1999 Sharma
D423,130 S 4/2000 Kung
6,146,001 A 11/2000 Cwiakala
6,206,541 B1 3/2001 Landamia
D456,546 S 4/2002 Bernard
6,390,652 B1 5/2002 Echito
6,406,161 B1 6/2002 Lin et al.
6,536,924 B2 3/2003 Segretto
6,566,824 B2 5/2003 Panagotacos et al.
6,588,920 B2 7/2003 Agro
6,619,813 B1 * 9/2003 Schnell ..... 362/116
6,641,283 B1 11/2003 Bohler
6,726,502 B1 4/2004 Hayes
D490,925 S 6/2004 Wilmotte
D497,216 S 10/2004 Lee
6,827,465 B2 12/2004 Shemitz et al.
6,877,875 B2 4/2005 Yu et al.
D506,560 S 6/2005 Oas
D507,373 S 7/2005 Kim
6,955,442 B1 10/2005 Chan
6,979,107 B1 12/2005 Benensohn
7,021,790 B2 * 4/2006 Parsons ..... 362/191
D522,677 S 6/2006 Ming
D522,678 S 6/2006 Wang
D523,984 S 6/2006 Cai
7,066,619 B2 6/2006 Waters
D525,381 S 7/2006 Hodgson
D526,433 S 8/2006 Li
D526,734 S 8/2006 Brown
D542,455 S 5/2007 Newcomb
D542,457 S 5/2007 Fisherman et al.
7,270,443 B2 9/2007 Kurtz et al.
D561,925 S 2/2008 Levine
D563,013 S 2/2008 Levine
D563,014 S 2/2008 Levine
D563,582 S 3/2008 Levine
D564,118 S 3/2008 Wu
D576,334 S 9/2008 Levine
D576,338 S 9/2008 Levine
D578,246 S 10/2008 Levine
D578,703 S 10/2008 Levine
D581,077 S 11/2008 Levine
D581,569 S 11/2008 Levine
D581,570 S 11/2008 Levine
D581,571 S 11/2008 Levine
D581,572 S 11/2008 Levine
2001/0009511 A1 7/2001 Griffiths
2002/0145876 A1 10/2002 Juang
2003/0179572 A1 * 9/2003 Schnell ..... 362/191
2004/0240090 A1 12/2004 Skiver et al.
2005/0007778 A1 * 1/2005 Lin ..... 362/250
2006/0050519 A1 3/2006 Lin
2006/0092637 A1 5/2006 Yeh
2006/0250789 A1 11/2006 Coushaine
2006/0256584 A1 11/2006 Paoluccio
2007/0070645 A1 3/2007 Coushaine et al.
2007/0097689 A1 5/2007 Barausky et al.

OTHER PUBLICATIONS

"Koncept Z-Bar LED Lamp," http://www.konceptech.com/Merchant2/merchant.mv?Screen=Prod&Store_Code=K&Product_Code=LL3001-MBK, visited Jan. 27, 2007, 1 page.
U.S. Appl. No. 11/954,225, filed Dec. 12, 2007, Levine.
U.S. Appl. No. 29/298,708, filed Dec. 12, 2007, Levine.

* cited by examiner

LIGHTING DEVICE WITH CLIP

CROSS REFERENCE TO RELATED APPLICATIONS

This claims the benefit of the earlier filing dates of prior U.S. Provisional Application No. 60/873,658, filed Dec. 8, 2006, and prior U.S. Provisional Application No. 60/878,733, filed Jan. 4, 2007, both of which are incorporated herein by reference.

FIELD

This disclosure concerns lighting devices that can be held in position by a clip, such as utility lamps adapted to clip onto the edge of a table.

BACKGROUND

Several varieties of lighting devices having clips for mounting are known. For example, some conventional lighting devices include clips in place of standard bases. Clips can make a lighting device essentially integral with a stationary object. This is useful, for example, when the lighting device is to be mounted on a non-horizontal surface (e.g., a picture frame) or when the lighting device is adjustable into positions that would cause an unclipped lighting device to tip over. In contrast to other mounting systems, clips also typically allow a lighting device to be removed and remounted with relative ease.

One example of a known clip-on lighting device is disclosed in U.S. Pat. No. 4,494,177 (Matthews). Mathews describes an articulated task lamp adapted for mounting to a drafting table (abstract). The lamp described in Mathews includes a base portion defining "a clamping zone . . . adapted to receive edge margins of a table top or drawing board" (FIG. 1 and column 3, lines 49-53). A "clamp knob" can be tightened to frictionally grip the edge margins of the table top or drawing board within the clamping zone (column 3, lines 54-57). As another example, U.S. Patent Publication No. 2003/0179572 (Schnell 1) describes a small utility light adapted to clip onto the pages of a book to provide light for reading (abstract). As a final example, U.S. Pat. No. 6,619,813 (Schnell 2) describes a small light removably mounted to a clip member and sized to be attached to a key ring (abstract).

SUMMARY

Disclosed herein are embodiments of a lighting device, such as a battery-powered lighting device. Some embodiments include a light source housing, a base connected to the light source housing, and a clip removably connected to the base. The base can be configured to act as a stable support for the lighting device when the lighting device is positioned upright over a flat support surface with the clip disconnected front the base. Similarly, the clip (or the clip in conjunction with a portion of the base) can be configured to act as a stable support for the lighting device when the lighting device is positioned upright over a flat support surface with the clip connected to the base.

The clip can be removably connected adjacent to a bottom surface of the base. For example, the base can have an underside facing the flat support surface when the lighting device is positioned upright over the flat support surface with the clip disconnected from the base, and the underside can include a channel for slidingly receiving the clip. In some embodiments, the underside of the base is substantially flat around the channel. The clip can be configured to releasably connect to the base in a first orientation and a second orientation substantially opposite to the first orientation. For example, in embodiments in which the base has an underside with a channel, the channel can be configured to slidingly receive the clip when the clip is oriented in a first direction and to slidingly receive the clip when the clip is oriented in a second direction opposite to the first direction.

The clip can include a first clipping member, a second clipping member, and a resilient member configured to press a gripping portion at a front end of the first clipping member against a gripping portion at a front end of the second clipping member. In some embodiments, the first clipping member has a substantially flat upper surface, the second clipping member has a substantially flat lower surface, and the lighting device is configured to be supported at least partially on the lower surface of the second clipping member when the base is positioned upright over a flat support surface with the clip connected to the base. In such embodiments, the base can include a channel with lateral grooves configured to slidingly receive lateral protrusions on the first clipping member.

In addition to a light source housing, a base, and a clip, some embodiments also include an elongated member connecting the light source housing to the base. These embodiments can include a first hinge between the elongated member and the light source housing and a second hinge between the elongated member and the base. The light source housing can include a battery compartment as well as an LED or a plurality of LEDs. A power switch can be positioned on the light source housing to turn the LEDs on or off. In some embodiments, the light source housing is rotatable in two separate planes. The light source housing also can be movable between a compact configuration and an expanded configuration.

Also disclosed are embodiments of a lighting device kit. These embodiments can include a clip and a lighting device main assembly including a light source housing and a base connected to the light source housing. The base can be configured to act as a stable support for the lighting device when the lighting device is positioned upright over a flat support surface. The clip can include at least one protrusion shaped to slide into a lateral groove in an underside of the base so as to releasably connect the clip to the base. In some embodiments, the clip is configured to releasably connect to the base in a first orientation and a second orientation substantially opposite to the first orientation.

DETAILED DESCRIPTION

Throughout this disclosure, the singular terms "a," "an," and "the" include plural referents unless the context clearly indicates otherwise. Similarly, the word "or" is intended to include "and" unless the context clearly indicates otherwise. As used herein the term "clip" refers to any device having one or more movable elements adapted to releasably grip an object, including devices having one or more resilient members capable of applying gripping pressure (e.g., spring-loaded alligator clips) and devices that can be manually tightened to apply gripping pressure (e.g., screw-tightened clamps). Directional terms, such as "upper," "lower," "front," "back," "vertical," and "horizontal," are used herein to express and clarify the relationship between various elements. It should be understood that such terms do not denote absolute orientation (e.g., a "vertical" component can become horizontal by rotating the device).

Described herein are embodiments of a lighting device and embodiments of a lighting device kit. In contrast to conventional clip-on lighting devices, some embodiments of the disclosed lighting device include a main assembly that can be supported on a clip or supported on a base, such as a base having a substantially flat bottom surface. This versatility makes these embodiments highly adaptable to different installations. To add even greater versatility, the clip can be removable and capable of attachment to the main assembly in more than one orientation. For example, the clip can slide into a channel on a bottom surface of the base of the main assembly in a first orientation with gripping portions of the clip at the front of the lighting device or in a second orientation with gripping portions of the clip at the rear of the lighting device. This allows the orientation of the entire lighting device to be reversed as necessary.

Figure 1:
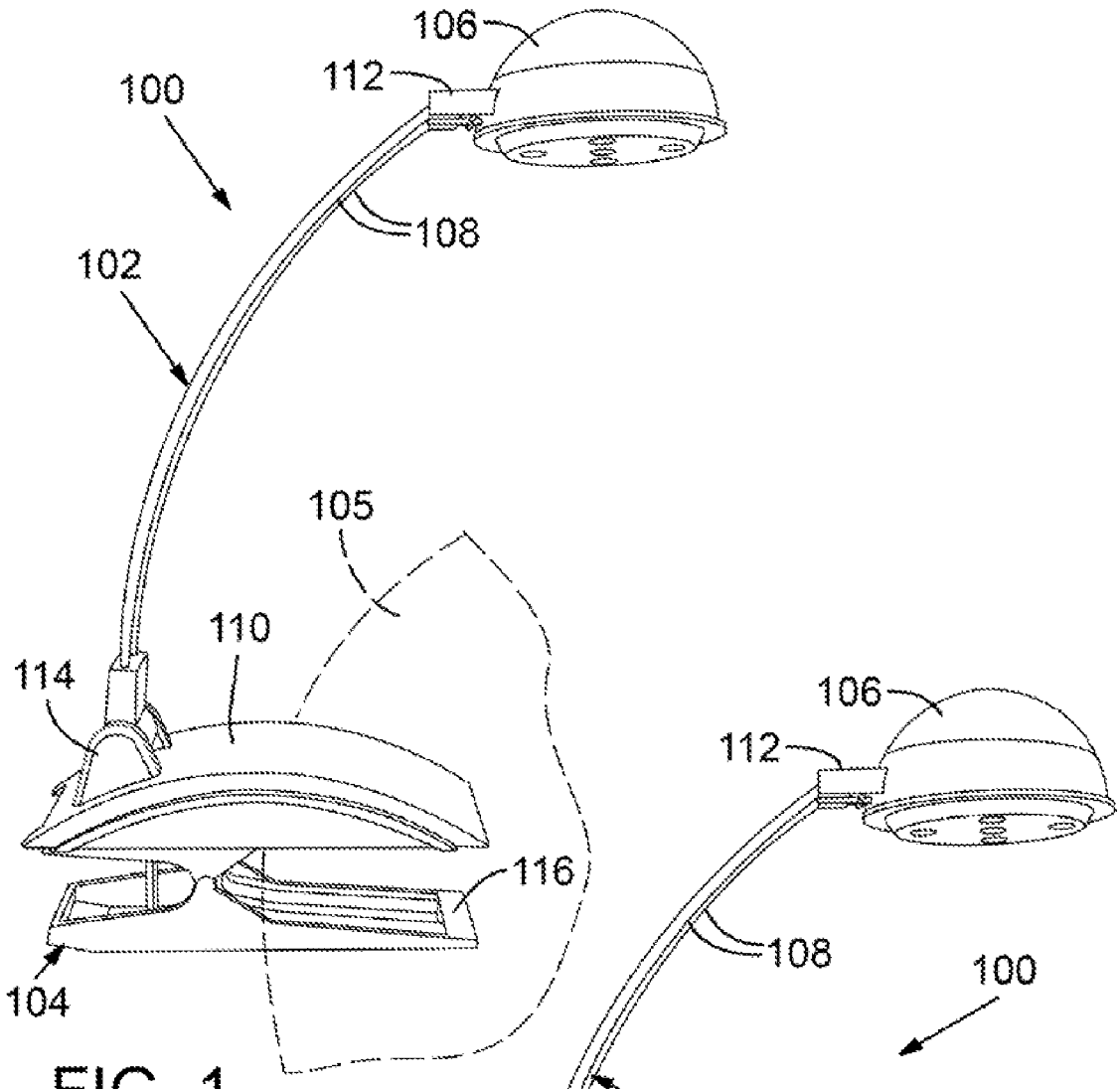
FIG. 1 is a perspective view of one embodiment of the disclosed lighting device with a clip thereof attached in a first orientation and clipped to an edge of a table top such that a light source housing of the lighting device is positioned over the table top.
Figure 2:
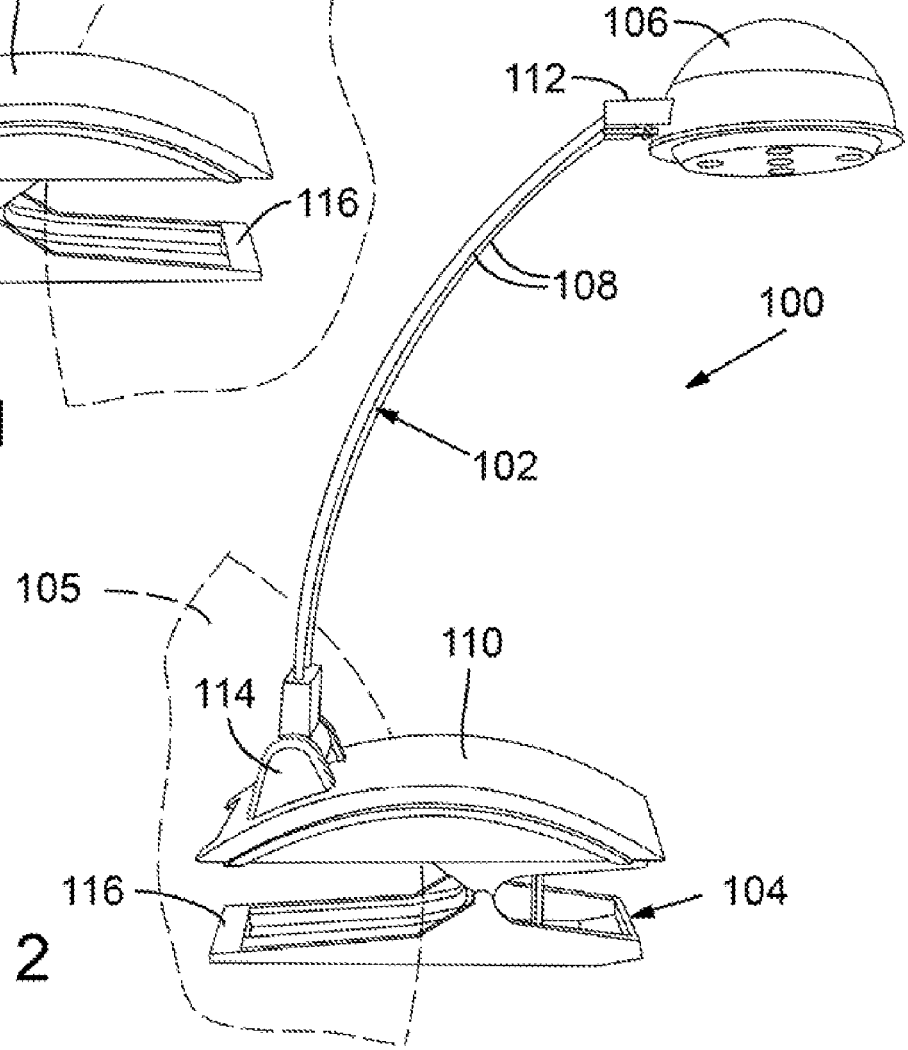
FIG. 2 is a perspective view of the embodiment shown in FIG. 1 with the clip attached in a second orientation and clipped to the edge of the table top such that the light source housing is positioned over an area adjacent to the table top.

FIGS. 1-7 illustrate an embodiment of the disclosed device. As shown in FIGS. 1 and 2, the device 100 includes a main assembly 102 and a clip 104. The clip 104 is attached to a table edge portion 105. The main assembly 102 includes a light source housing 106, two elongated members 108, and a base 110. The light source housing 106 is connected to the elongated members 108 by a first hinge 112. Similarly, the elongated members 108 are connected to the base 110 by a second hinge 114. The first and second hinges 112, 114 allow the position of the light source housing 106 to be manually adjusted. Both the first and second hinges 112, 114 allow for forward and reverse radial movement in a plane substantially perpendicular to a top surface of the table edge portion 105. In other embodiments, one or both of the first and second hinges 112, 114 may additionally or separately allow for radial movement in another plane, such as a plane substantially parallel to the top surface of the table edge portion 105.

Rotatable elements (not shown) in the first hinge 132 preferably are held together with substantial friction. This friction holds the light source housing 106 in position after adjustment. In the second hinge 114, two rounded projections (not shown) connected to the elongated members 108 are capable of rotating within "U" shaped members (not shown) connected to the base 110. The "U" shaped members are flexible and resilient (i.e., made of flexible and resilient metal) and include bumps that fit into indentations around the perimeter of each rounded projection. When the second hinge 114 is rotated, the "U" shaped members flex open to allow movement of each bump from one indentation to another. Since deliberate force is required to cause the "U" shaped members to flex open, the elongated members 108 remain in position after adjustment.

FIG. 1 shows the device 100 with the clip 104 connected to the base 110 of the main assembly 102 in a first orientation with gripping portions 116 (one shown in FIG. 1) of the clip positioned near the front of the device. In contrast, FIG. 2 shows the device 100 with the clip 104 connected to the base 110 of the main assembly 102 in a second orientation with the gripping portions 116 (one shown in FIG. 2) of the clip positioned near the rear of the device. As a result of the different orientations of the clip 104, the light source housing 106 in FIG. 1 is positioned to shine light over the table edge portion 105, while the light source housing in FIG. 2 is positioned to shine light over an area adjacent to the table edge portion. The configuration shown in FIG. 2 is useful, for example, if the only available structure for mounting is a shelf or some other structure terminating in an edge adjacent to an area to be illuminated.

Figure 3:
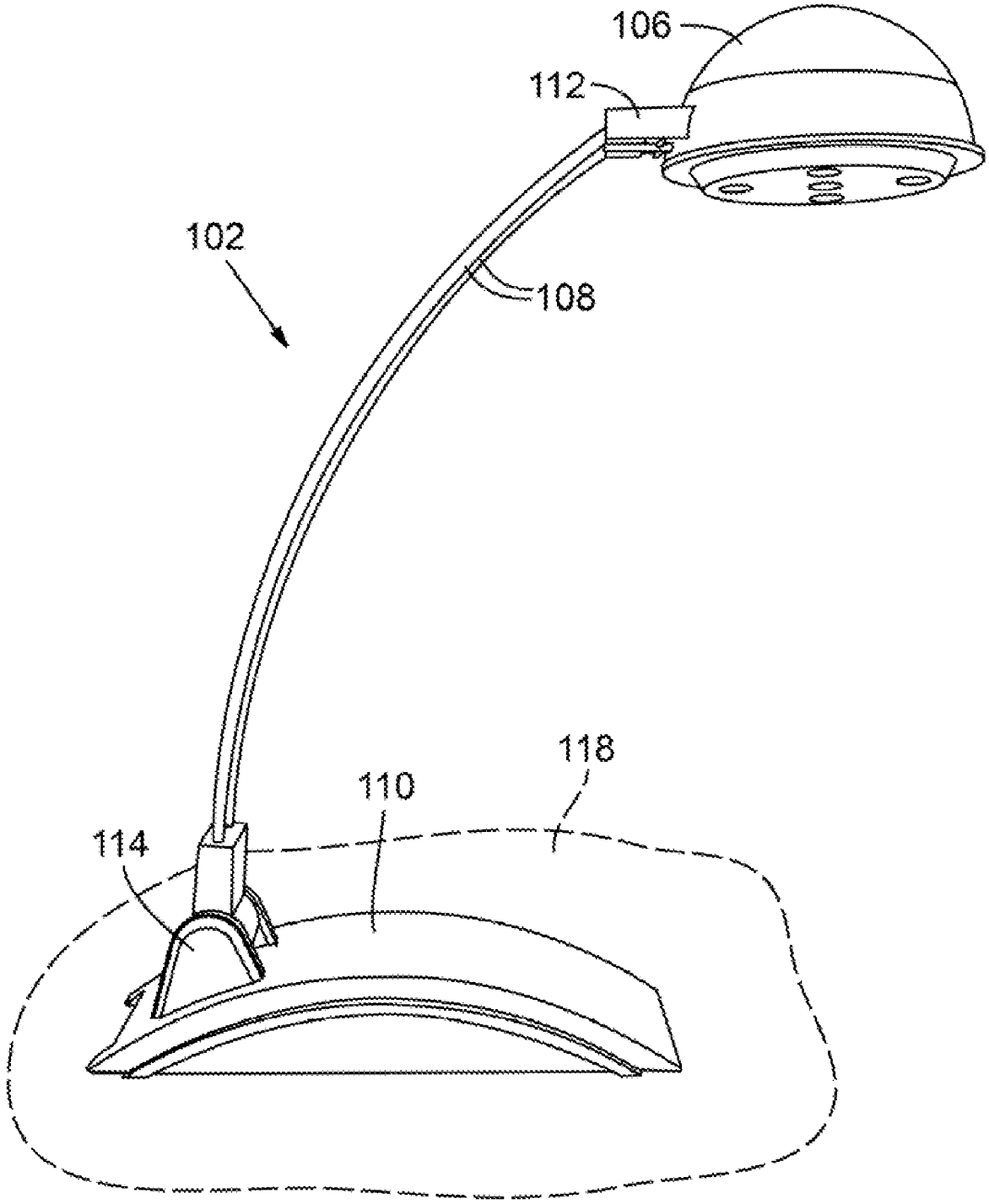
FIG. 3 is a perspective view of a main assembly of the embodiment shown in FIGS. 1 and 2 separate from the clip.

As shown in FIG. 3, the main assembly 102 is capable of sitting substantially flat on a flat surface 118 when the clip 104 is removed. Since the clip 104 has wide and substantially flat top and bottom surfaces, the device 100 also can support itself on the flat surface 118 when the clip 104 is attached to the main assembly 102 in either of the orientations shown in FIGS. 1 and 2. The illustrated clip 104, however, has non-perpendicular top and bottom surfaces when the clip is at rest and no structure is positioned between the gripping portions 116. Thus, when the clip 104 is attached and the device 100 is resting on the flat surface 118, the bottom surface of the base 110 typically is angled relative to the flat surface. When the clip 104 is attached to the main assembly 102 in the first orientation, the device 100 can be supported on both the clip and a front corner of the base 110 (i.e., the corner formed by the edge of the base closest to the gripping portions 116). When the clip 104 is attached to the main assembly 102 in the second orientation, the device 100 can be supported on the clip only. In some embodiments, the top and bottom surfaces of the clip 104 are substantially parallel when the clip is at rest and no structure is positioned between the gripping portions 116. In such embodiments, the device 100 may sit flat on the flat surface 118 with the clip 104 removed or attached to the main assembly 102.

Figure 4:
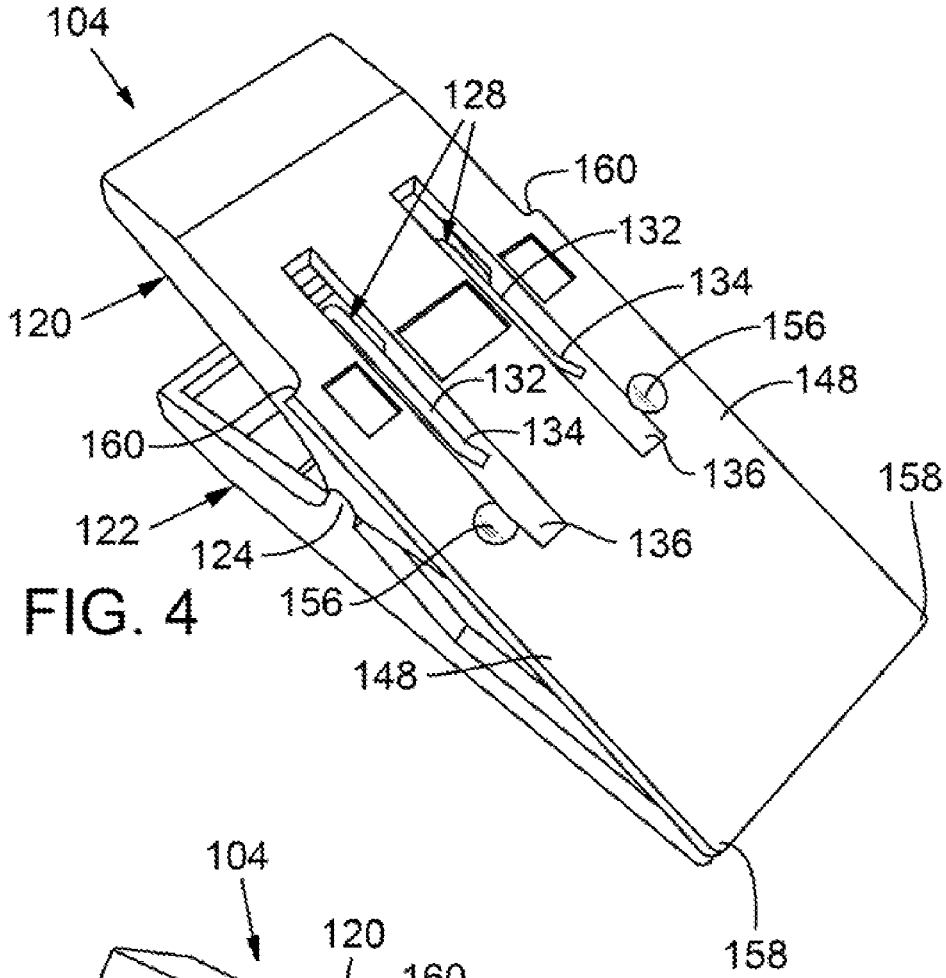
FIG. 4 is a perspective view of the clip of the embodiment shown in FIGS. 1 and 2 separate from the main assembly.
Figure 5:
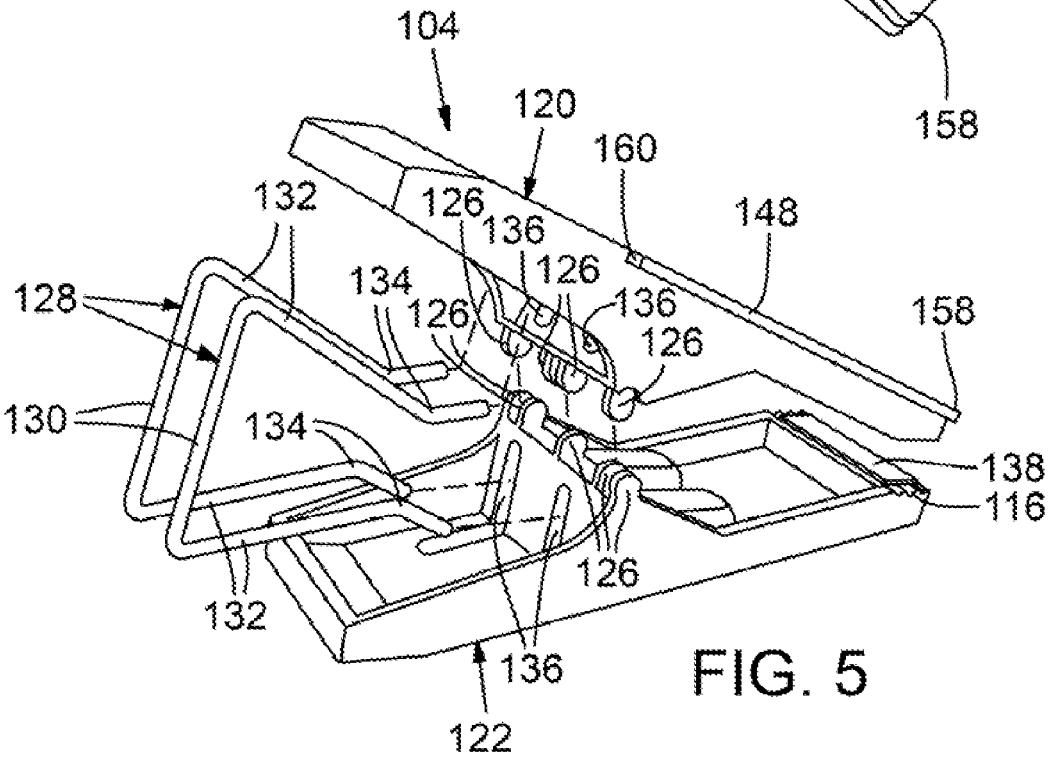
FIG. 5 is an exploded perspective view of the clip shown in FIG. 4.

FIG. 4 is a perspective view of the clip 104. FIG. 5 is an exploded perspective view of the clip 104. The clip 104 includes a first clipping member 120 and a second clipping member 122. The first and second clipping members 120, 122 pivot relative to each other at a clip hinge 124. In the illustrated clip 104, the clip hinge 124 is formed by interlocking tabs 126 on the first and second clipping members 120, 122. The tabs 126 are rounded to fit within rounded recesses between the tabs of the opposite clipping member. As the first and second clipping members 120, 122 move relative to one another, the rounded portions of the tabs 126 rotate within the recesses between the tabs of the opposite clipping member.

The first and second clipping members 120, 122 are held together by two resilient members 128. In this embodiment, the resilient members 128 are metal, but other resilient materials also could be used. Each resilient member 128 includes a back portion 130 and two arms 132. The back portion 130 and the arms 132 form a triangular shape, but rather than meeting at a point, an end portion of each arm bends outward at an elbow 134. To assemble the clip 104, one arm 132 of each resilient member 128 slides into a channel 136 in the first clipping member 120 and the other arm slides into a corresponding channel in the second clipping member 122. The resilient members 128 are held in place because the back portions 130 have to flex as the elbows 134 slide over rounded bulges (not shown) on the inside surfaces of the channels 136. Once in place, the resilient members 128 flex as the first and second clipping members 120, 122 pivot at the clip hinge 124 in response to squeezing pressure on the ends of the first and second clipping members opposite to the gripping portions 116. Pressure from the flexed resilient members 128 allows the gripping portions to press against either side of an object. When the object is removed from between the gripping portions 116, the resilient members 128 force the first and second clipping members 120, 122 back into their original positions with opposed gripping portions preferably engaging one another. To further improve the gripping strength, each of the gripping portions 116 includes a rubberized pad 138.

Figure 6:
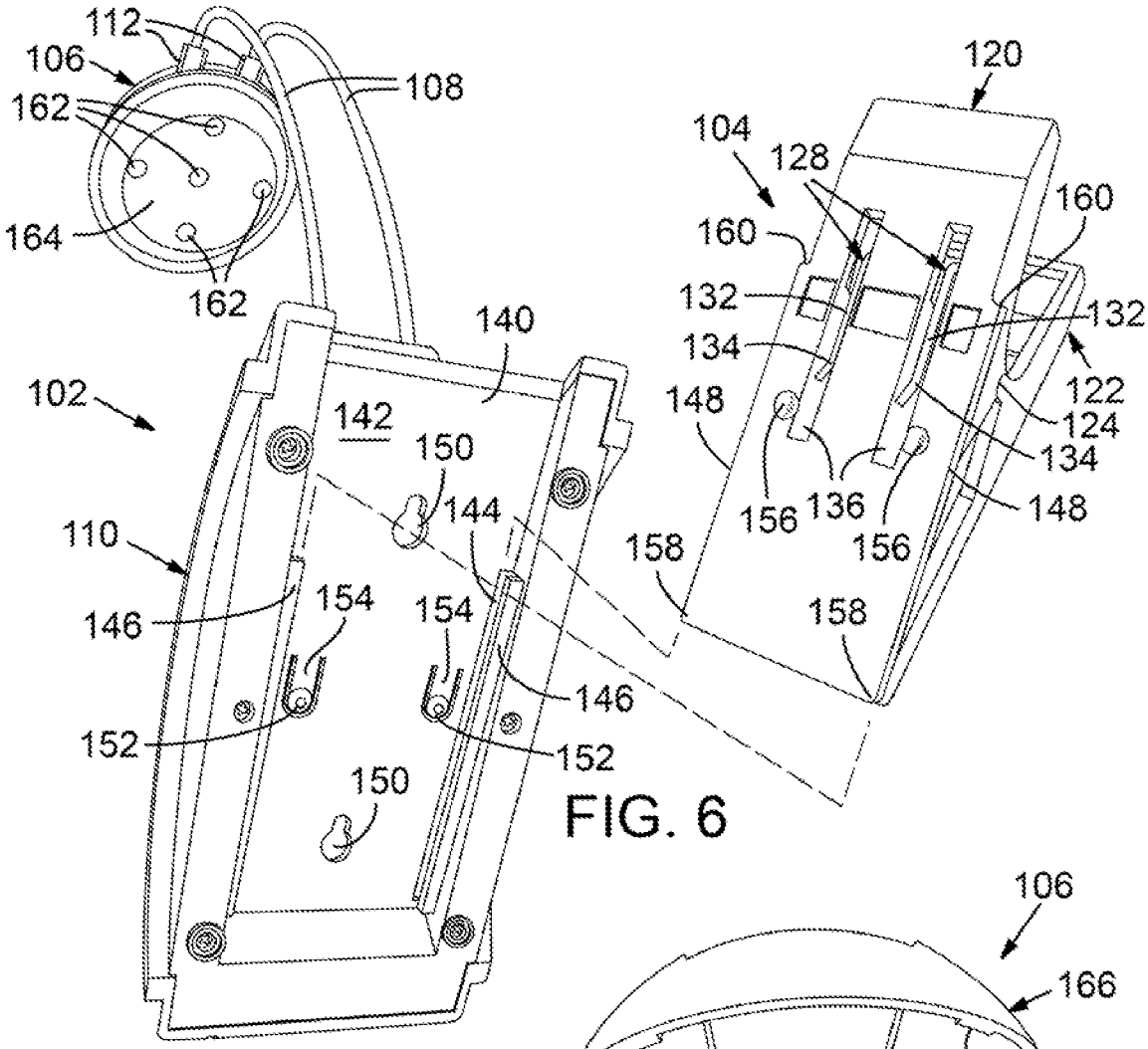
FIG. 6 is an exploded perspective view of the embodiment shown in FIGS. 1 and 2 showing the manner in which the clip is attached to an underside of a base of the main assembly in a first orientation.

FIG. 6 illustrates attachment of the clip 104 to the base 110 of the main assembly 102. The bottom surface of the base 110 of the main assembly 102 includes a main channel 140 with a top surface 142. On each side of the main channel 140 there is a side channel 144 formed between the top surface 142 of the main channel and a channel-forming member 146. The first clipping member 120 is sized to slide into the main channel 140 such that side projections 148 on either side of the first clipping member fit within the side channels 144. The length of the main channel 140 is substantially the same as the length of the first clipping member 120 so that, when the first clipping member is fully inserted, its back edge is substantially even with a back edge of the base 110. The channel-forming members 146 and the side projections 148 extend along only a portion (i.e., about the front two thirds) of the lengths of the main channel 140 and the first clipping member 120, respectively.

When installed, the clip 104 is held in place vertically by the channel-forming member 146 and horizontally by friction between the side projections 148 and the side channels 144. For additional support against unwanted horizontal movement of the clip 104 relative to the base 110, the top surface 142 of the main channel 140 includes two bumps 152 mounted on cutouts 154. Sliding the clip 104 into the main channel 140 presses the bumps 152 upward, causing the cutouts 154 to flex. When the clip 104 is fully inserted into the main channel 140, the bumps 152 are able to move downward into recesses 156 on the top surface of the first clipping member 120. The interlocking relationship between the bumps 152 and the recesses 156 helps to prevent the clip 104 from sliding out of position unless deliberate force is applied. When deliberate force is applied, the cutouts 154 again flex upward to allow the clip 104 to slide out of the main channel 140.

The clip 104 can be inserted into the main channel 140 in two different orientations. In a first orientation, as shown in FIG. 1, the gripping portions 116 (i.e., clamping ends) of the clip 104 are positioned at the front of the device 100. In a second orientation, as shown in FIG. 2, the gripping portions 116 (i.e., clamping ends) are positioned at the rear of the device 100. In both orientations, the first clipping member 120 is positioned adjacent to the top surface 142 of the main channel 140 and the side projections 148 of the first clipping member at least partially fit into the side channels 144. As shown in FIG. 6, each side projection 148 has a front end 158 and a back end 160. In the first orientation, the front ends 158 of the side projections 148 slide into the side channels 144 first. In the second orientation, the back ends 160 of the side projections 148 slide into the side channels 144 first. The side projections 148 do not extend along the entire length of the first clipping member 120. Thus, in the second orientation, a portion of the first clipping member 120 without side projections 148 slides between the channel-forming members 146 before the back ends 160 of the side projections 148 slide into the side channels 144. In the illustrated embodiment, the bumps 152 and the recesses 156 only become aligned when the first clipping member 120 is fully inserted in the first orientation. In other embodiments, the bumps 152 and the recesses 156 are capable of becoming aligned in both orientations.

As discussed above, the main assembly 102 also can be used without the clip 104. In addition to sitting substantially flat on a horizontal surface, as shown in FIG. 3, the main assembly 102 can be mounted to a vertical or angled surface. For example, mounting holes 150 (FIG. 6) in the top surface 142 of the main channel 140 can be used to mount the main assembly 102 to a wall or other surface with the bottom surface of the base 110 adjacent and parallel to the wall or other surface. For example, the mounting holes 150 can be used to receive the beads of screws or other fasteners attached to the wall or other surface.

FIG. 6 also illustrates the bottom surface of the light source housing 106. The illustrated embodiment includes five lighting elements 162, but other embodiments may include a different number of lighting elements, such as one, two, three, four, six, seven, eight, nine, ten or a greater number of lighting elements. The lighting elements 162 are mounted on a reflective plate (not shown) and enclosed by a face plate 164. In the illustrated embodiment, the lighting elements 162 are white LEDs. In other embodiments the lighting elements 162 can be incandescent, fluorescent, halogen, xenon, neon, or some other commercially-available lighting type. LEDs are particularly well suited for use in disclosed embodiments due to their compact size, low power demand, low beat output, long life and high durability. Instead of white LEDs, other embodiments may include LEDs of another color, such as red, orange, yellow, green or blue.

Figure 7:
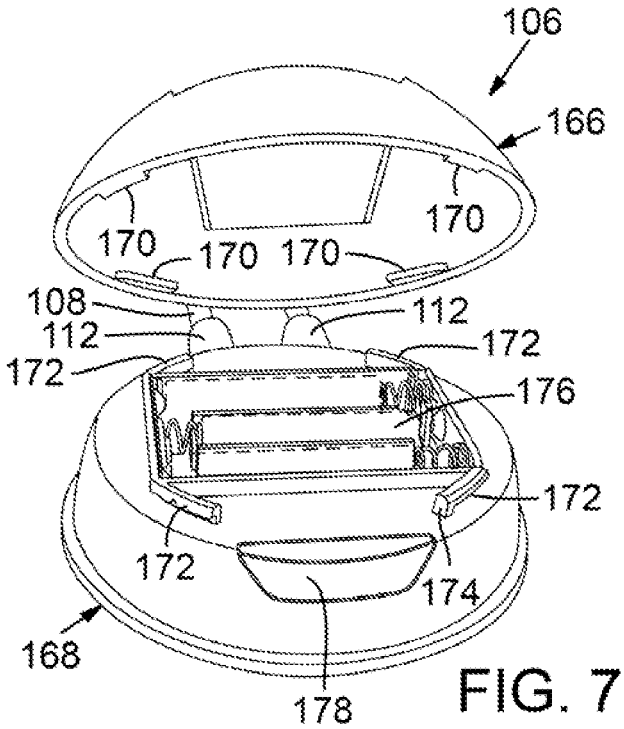
FIG. 7 is an exploded perspective view of the light source housing of the embodiment shown in FIGS. 1 and 2.

FIG. 7 is an exploded perspective view of the light source housing 106. The light source housing 106 includes a cap 166 and a bottom portion 168. Four locking projections 170 are positioned on the inside of the cap 166. The bottom portion 168 includes four channel-forming members 172 at positions corresponding to the positions of the locking projections 170. To secure the cap 166 to the bottom portion 168, the cap is placed on the bottom portion with the locking projections 170 between the channel-forming members 172. The cap 166 is then twisted causing the locking projections 170 to slide into channels in the channel-forming members 172 until they abut closed ends 174 (one shown in FIG. 7) of each channel-forming member 172.

The bottom portion 168 includes a battery compartment 176. In the illustrated embodiment, the battery compartment 176 is configured to hold three AAA batteries. These batteries are electrically connected in series with soldered connections (not shown) at the beginning and end of the series. Wires extending from the soldered connections provide power to a circuit board (not shown) to which the lighting elements 162 are attached. Other embodiments may include different power supply configurations. Embodiments powered by batteries can include any number, type and arrangement of batteries, such as two AA batteries in parallel or one nine volt battery directly connected to the circuit. Other embodiments may be hard wired to a permanent power source, such as a wall circuit.

FIG. 7 also shows a power button 178 at the front of the bottom portion 168 of the light source housing 106. When the power button 178 is depressed, the lighting elements 162 turn on or off. The power button 178 also can be configured to toggle the lighting elements 162 between levels of light intensity. For example, a single press of the power button 178 may turn the lighting elements 162 on, a second press of the power button may increase the light intensity and a third press of the power button may turn the lighting elements off. Alternatively, the power button 178 can be configured to toggle between the activation of different numbers of lighting elements 162 from among a plurality of lighting elements. For example, a single press of the power button 178 may turn on a limited number of lighting elements 162, a second press of the power button may increase the number of illuminated lighting elements, and a third press of the power button may turn all the lighting elements off. The functionality of toggling the light intensity or the number of illuminated lighting elements can be incorporated by including a commercially-available dimmer or toggle switch on the circuit board. Instead of a power button 178, other embodiments may include another type of switch, such as a toggle switch or a rocker switch. Such switches can be positioned, for example, on a portion of the device 100 other than the bottom portion 168 of the light source housing 106.

In the device 100 illustrated, in FIGS. 1-7, the clip 104 removably attaches to the main assembly 102 by sliding into the main channel 140 on the underside of the base 110. In other embodiments, the clip 104 can be removably attached to the main assembly 102 by some other mechanism. For example, the clip 104 can be removably attached to the main assembly 102 by a commercially-available hook-and-loop fastener or a commercially-available peel-and-stick fastener. Alternatively, the clip 104 can be attached to the main assembly 102 by an additional clipping mechanism. The clip 104 typically is attached to the underside of the base 110. In some embodiments, however, the clip 104 is attached to another side of the base 110 (e.g., one of the vertical sides) or another portion of the main assembly 102 (e.g., one of the elongated members 108).

Figure 8:
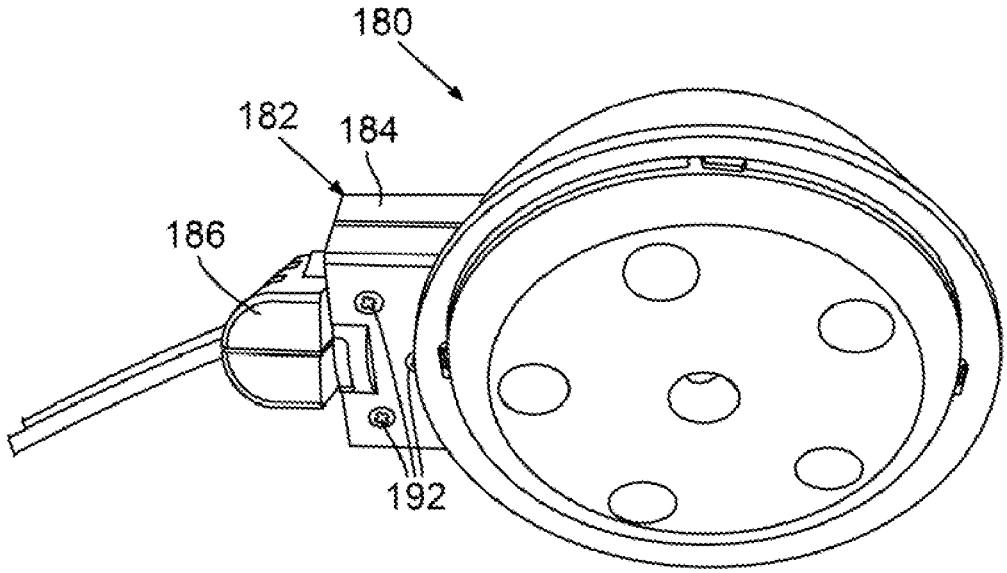
FIG. 8 is a perspective view of an alternative light source housing embodiment.
Figure 9:
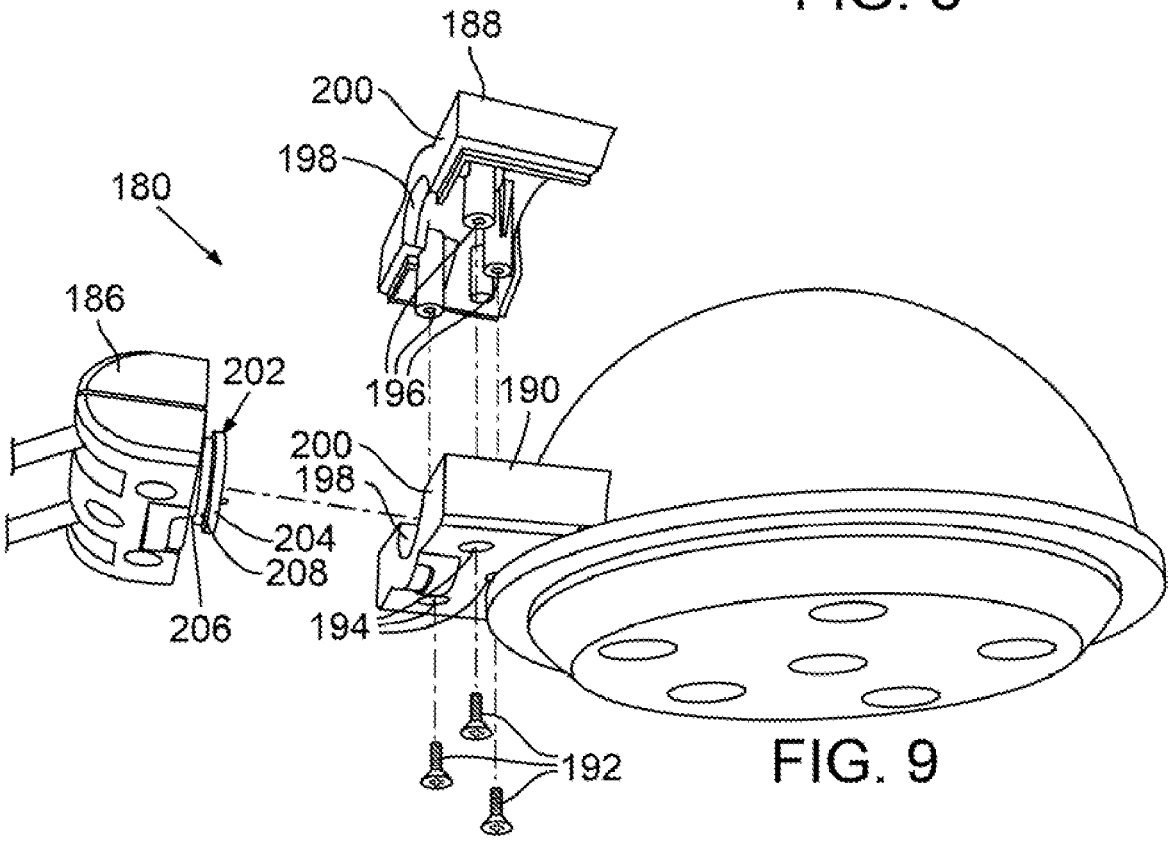
FIG. 9 is a partially exploded perspective view of the light source housing embodiment shown in FIG. 8.

FIGS. 8-9 illustrate another embodiment of a light source housing that can be used with embodiments of the disclosed lighting device. The light source housing 180 shown in FIGS. 8-9 is similar to the light source housing 106 of the embodiment shown in FIGS. 1-7. Unlike the light source housing 106, however, the light source housing 180 is rotatable in two separate planes. The light source housing 180 includes a rear projection 182 with a first portion 184 and a second portion 186. The first portion 184 is rotatable relative to the second portion 186. FIG. 8 shows the light source housing 180 with the first portion 184 partially rotated relative to the second portion 186 from a starting position in which the perimeters of the first portion and the second portion are aligned. The second portion 186 is rotatable relative to the remainder of the lighting device (not shown) in substantially the same manner as the first hinge 112 of the embodiment shown in FIGS. 1-7.

FIG. 9 is a partially exploded perspective view of the light source housing 180. The first portion 184 of the rear projection 182 includes a top section 188 and a bottom section 190. When the light source housing 180 is assembled, screws 192 project through holes 194 in the bottom section 190 and into studs 196 in the top section 188 to hold together the top and bottom sections. Semi-circular recesses 198 in back walls 200 of the lop and bottom sections 188, 190 are shaped to fit around a cylindrical projection 202 of the second portion 186. The cylindrical projection 202 includes a rim 204 to secure edge portions of the back walls 200 within a channel 206 around the cylindrical projection. When the light source housing 180 is assembled, the edge portions of the back walls 200 around the semi-circular recesses 198 press against an o-ring 208 within the channel 206. The resulting friction allows the first portion 184 to remain in position alter rotation relative to the second portion 186.

Figure 10:
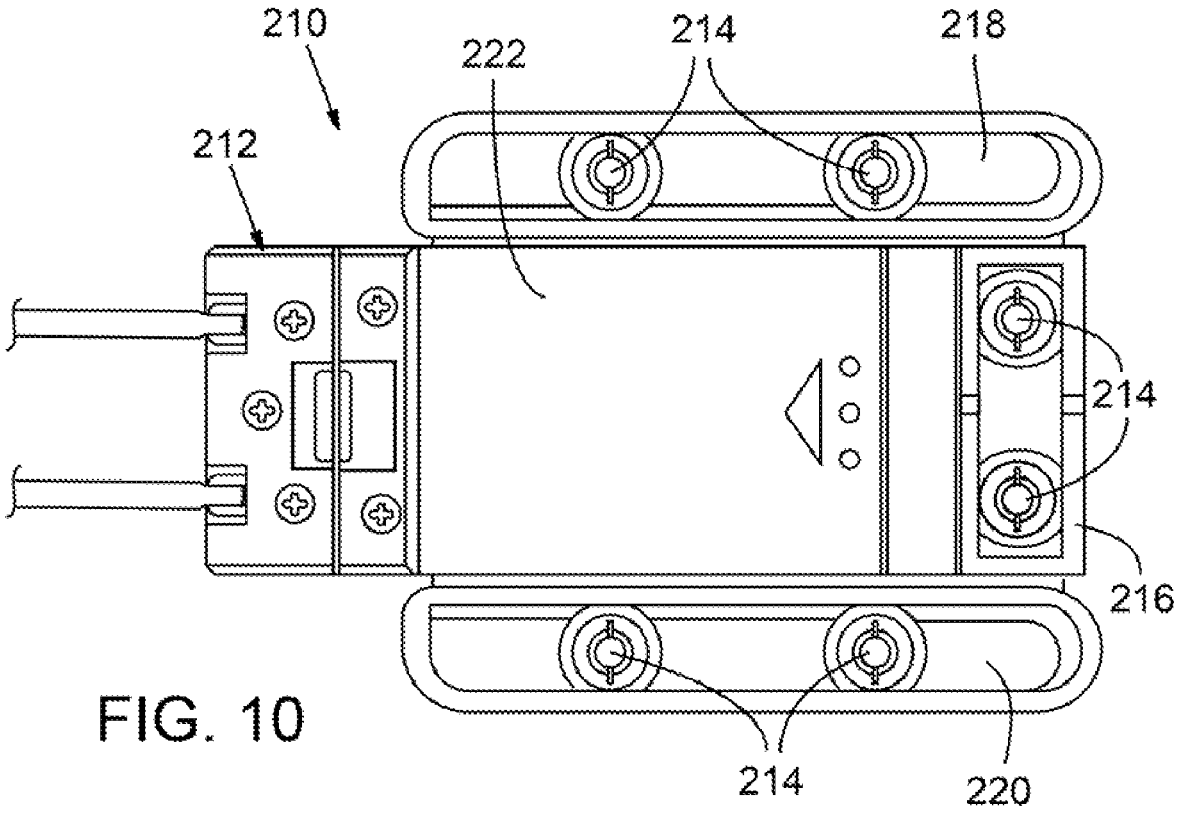
FIG. 10 is a front plan view of another alternative light source housing embodiment with its lighting elements in a first configuration.
Figure 11:
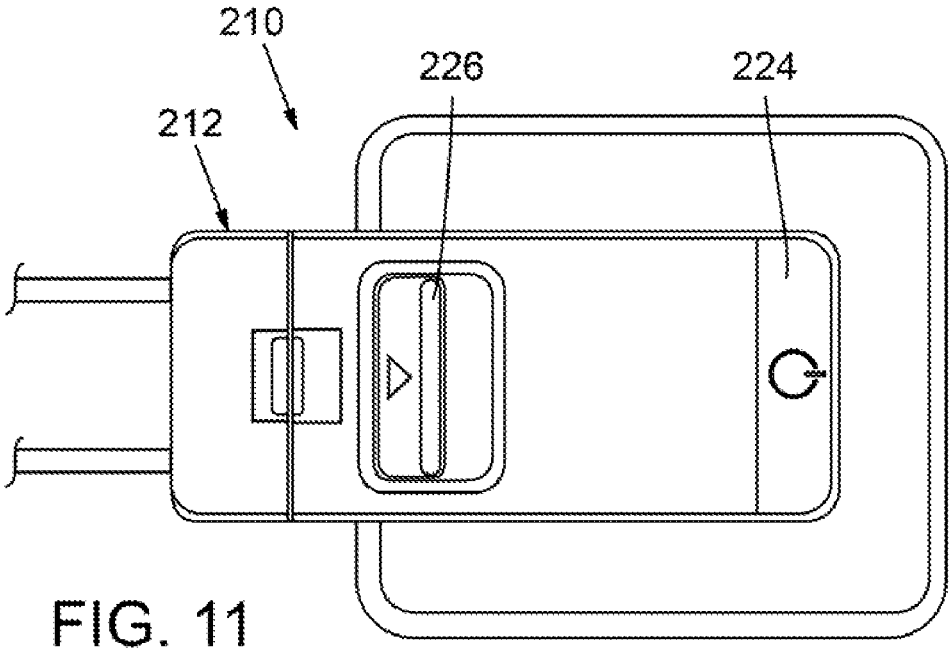
FIG. 11 is a back plan view of the light source housing embodiment shown in FIG. 10 with its lighting elements in the first configuration.
Figure 12:
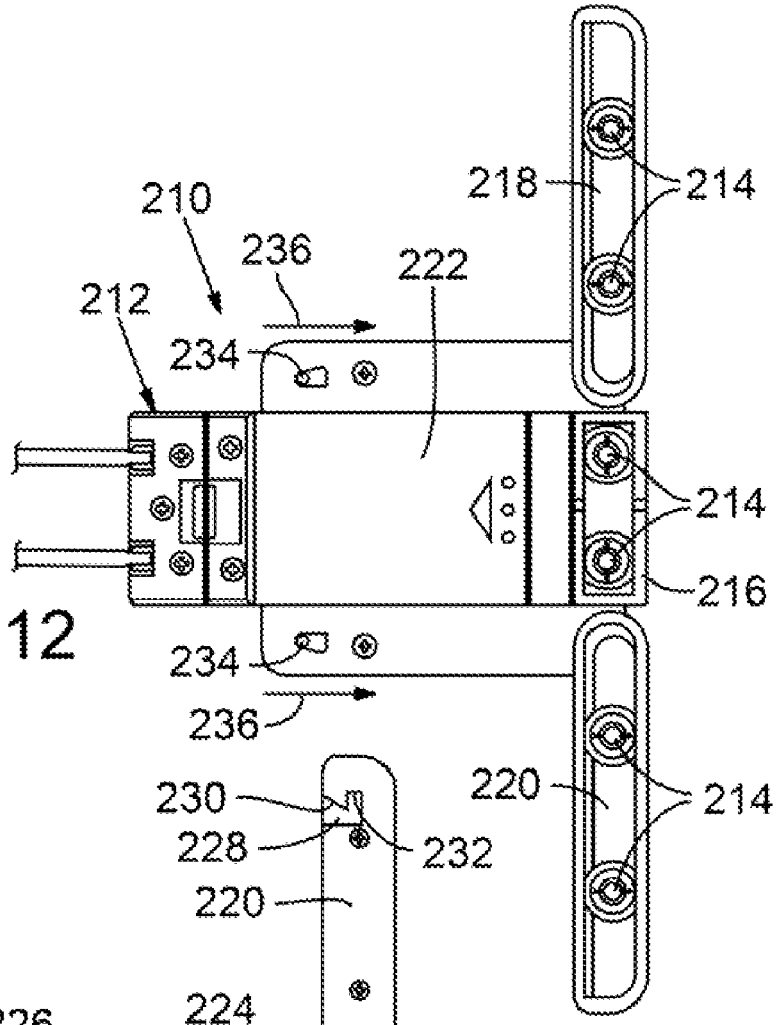
FIG. 12 is a front plan view of the light source housing embodiment shown in FIG. 10 with its lighting elements in a second configuration.
Figure 13:
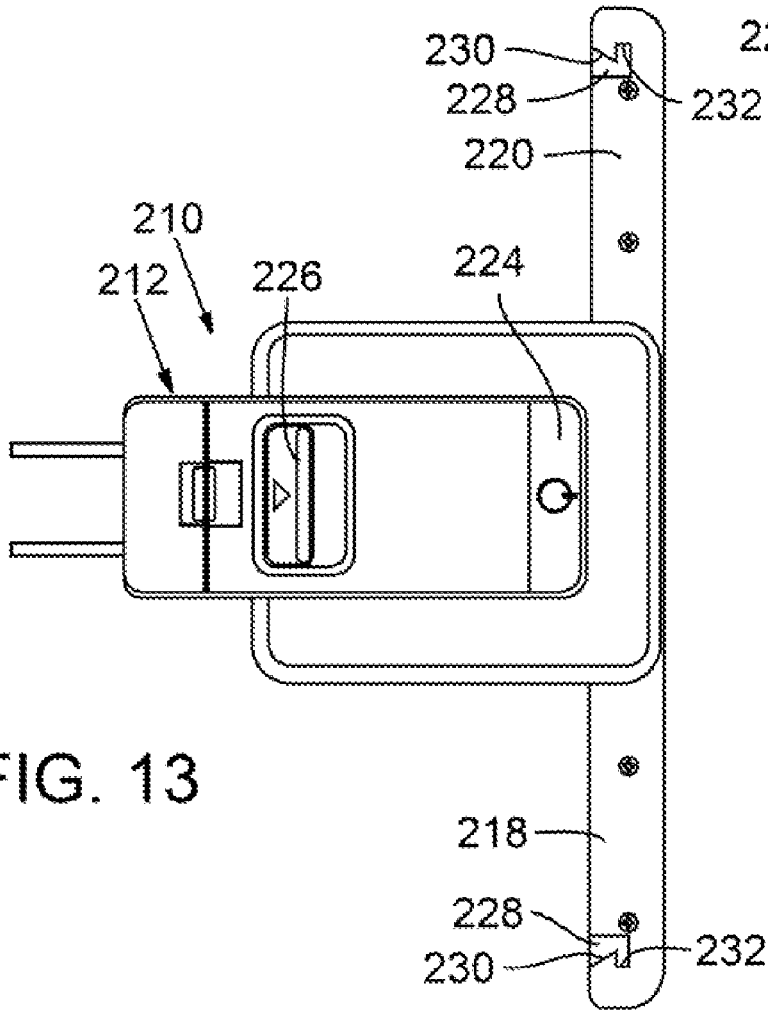
FIG. 13 is a back plan view of the light source housing embodiment shown in FIG. 10 with its lighting elements in the second configuration.

FIGS. 10-13 illustrate still another embodiment of a light source housing that can be used with embodiments of the disclosed lighting device. The light source housing 210 shown in FIGS. 10-13 includes a rear projection 212 substantially the same as the rear projection 182 of the light source housing 180 shown in FIGS. 8-9. Thus, the light source housing 210 also can rotate in two separate planes. Unlike the light source housing 106 and the light source housing 180, the arrangement of lighting elements 214 in the light source housing 210 can be switched between two different configurations. FIGS. 10 and 11 are plan views of front and back sides, respectively, of the light source housing 210 in a first configuration. FIGS. 12 and 13 are plan views of front and back sides, respectively, of the light source housing 210 in a second configuration.

As shown in FIGS. 10 and 12, the light source housing 210 includes six lighting elements 214. Two of the lighting elements 214 are positioned within a fixed bar 216, two of the lighting elements are positioned within a first movable bar 218, and two of the lighting elements are positioned within a second movable bar 220. In the first configuration illustrated in FIGS. 10 and 11, the fixed bar 216 and the first and second movable bars 218, 220 border a battery compartment 222 on three sides. The battery compartment 222 in the illustrated embodiment is configured to hold three AAA batteries. In the second configuration shown in FIGS. 12 and 13, the fixed bar 216 and the first and second movable bars 218, 220 are substantially aligned.

The back side of the light source housing 210, as shown in FIGS. 11 and 13, includes a power button 224 and a trigger 226. The power button 224 turns the lighting elements 214 on or off. The trigger 226, as described below, switches the light source housing 210 from the first configuration to the second configuration. As shown in FIG. 13, the first and second movable bars 218, 220 each include a channel 228 with an angled projection 230 and a slot 232. As shown in FIG. 12, the light source housing 210 includes a pin 234 corresponding to each of the channels 228. The pins 234 are capable of resiliently moving in the direction indicated by arrows 236. When one of the first and second movable bars 218, 220 is manually moved from its position shown in FIGS. 12 and 13 to its position shown in FIGS. 10 and 11, the angled projection 230 pushes the corresponding pin 234 in the direction indicated by arrows 236. Once it passes the angled projection 230, the pin 234 resiliently slides in the direction opposite to the direction indicated by arrows 236 and settles into the slot 232.

The first and second movable bars 218, 220 each include a hinge (not shown) adjacent to one end of the fixed bar 216. At the hinges, the first and second movable bars 218, 220 each include an internal biasing member (not shown) that causes the first and second movable bars to resiliently move into the second configuration shown in FIGS. 12 and 13. In the first configuration shown in FIGS. 10 and 11, the pins 234 prevent the first and second movable bars 218, 220 from moving in response to pressure on the biasing members. Pulling the trigger 226 moves the pins 234 in the direction indicated by arrows 236. This allows the first and second movable bars 218, 220 to spring into the second configuration.

Transitioning between the first configuration shown in FIGS. 10 and 11 and the second configuration shown in FIGS. 12 and 13 allows a user to select from two different illumination patterns. In the first configuration, the light source housing 210 illuminates a substantially circular area. In the second configuration, the light source housing 210 illuminates a more oblong area. One of these illumination patterns may be preferable to the other for certain applications.

The light source housing 180 shown in FIGS. 8-9 and the light source housing 210 shown in FIGS. 10-13 can be attached to other portions of an overall lighting device. For example, in some embodiments, the light source housing 180 and the light source housing 210 are attached to elongated members and bases in substantially the same manner as the light source housing 106 of the embodiment shown in FIGS. 1-7. Other features described above in relation to the embodiment shown in FIGS. 1-7, such as the clip 104, also can be used in conjunction with the light source housing 180 and the light source housing 210.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as our invention all that comes within the scope and spirit of these claims.

I claim:

1. A lighting device, comprising:

a light source housing including a light-emitting diode;

a base;

an elongated member connecting the light source housing to the base; and a clip removably connectable to the base and comprising a first clipping member, a second clipping member, and a resilient member configured to press a gripping portion at a front end of the first clipping member against a gripping portion at a front end of the second clipping member, wherein the lighting device is battery powered, the light source housing is rotatable in two separate planes, the base acts as a stable support for the lighting device when the lighting device is positioned upright over a flat support surface with the clip disconnected from the base, the base has an underside facing the flat support surface when the lighting device is positioned upright over the flat support surface with the clip disconnected from the base, and the base includes a channel for slidingly receiving the clip in a direction substantially parallel to the underside of the base.

2. The lighting device according to claim 1, wherein the clip acts as a stable support for the lighting device when the lighting device is positioned upright over the flat support surface with the clip connected to the base.

3. The lighting device according to claim 1, wherein the clip, in conjunction with a portion of the base, acts as a stable support for the lighting device when the lighting device is positioned upright over the flat support surface with the clip connected to the base.

4. The lighting device according to claim 1, wherein the clip is configured to releasably connect to the base in a first orientation and a second orientation substantially opposite to the first orientation.

5. The lighting device according to claim 1, wherein the light source housing comprises a battery compartment.

6. The lighting device according to claim 1, wherein the light source housing comprises a plurality of light-emitting diodes.

7. The lighting device according to claim 1, wherein the light source housing comprises a power switch.

8. The lighting device according to claim 1, wherein the light source housing is movable between a compact configuration and an expanded configuration.

9. The lighting device according to claim 1, further comprising a first hinge between the elongated member and the light source housing and a second hinge between the elongated member and the base.

10. The lighting device according to claim 1, wherein the underside of the base is substantially flat around the channel.

11. The lighting device according to claim 1, wherein the channel is configured to slidingly receive the clip when the clip is oriented in a first direction and to slidingly receive the clip when the clip is oriented in a second direction opposite to the first direction.

12. The lighting device according to claim 1, wherein the first clipping member has a substantially flat upper surface, the second clipping member has a substantially flat lower surface, and the lighting device is configured to be supported at least partially on the lower surface of the second clipping member when the base is positioned upright over, the flat support surface with the clip connected to the base.

13. The lighting device according to claim 1, wherein the channel includes lateral grooves configured to receive lateral protrusions on the first clipping member.

14. A lighting device, comprising:

a light source housing;

a base connected to the light source housing; and means for attaching the lighting device to an object in a first orientation and in a second orientation substantially opposite to the first orientation.

* * * * *